US010690405B2

(12) United States Patent
Heninger

(10) Patent No.: US 10,690,405 B2
(45) Date of Patent: Jun. 23, 2020

(54) METHODS AND APPARATUS FOR FREEZING A LIQUID

(71) Applicant: Messer Industries USA, Inc., Bridgewater, NJ (US)

(72) Inventor: Rolf Heninger, Höhenkirchen-Siegertsbrunn (DE)

(73) Assignee: Messer Industries USA, Inc., Wilmington, DE (US)

( * ) Notice: Subject to any disclaimer, the term of this patent is extended or adjusted under 35 U.S.C. 154(b) by 191 days.

(21) Appl. No.: 15/886,116

(22) Filed: Feb. 1, 2018

(65) Prior Publication Data

US 2019/0234685 A1 Aug. 1, 2019

(51) Int. Cl.

| | |
|---|---|
| ***F25D 31/00*** | (2006.01) |
| ***F25D 17/06*** | (2006.01) |
| ***F25D 11/00*** | (2006.01) |

(52) U.S. Cl.

CPC ..... *F25D 31/006* (2013.01); *F25D 11/006* (2013.01); *F25D 17/06* (2013.01); *F25D 2303/0822* (2013.01); *F25D 2317/067* (2013.01); *F25D 2331/801* (2013.01); *F25D 2400/30* (2013.01)

(58) Field of Classification Search

CPC .. F25D 31/006; F25D 17/06; F25D 2317/067; F25D 2331/801; F25D 2400/30; F25D 17/02; F25D 17/04; F25D 31/00; F25D 11/006; F25D 2303/0822; F25D 2331/8014; B61J 1/10; B65D 81/18; B65D 30/00; A61J 2200/44

See application file for complete search history.

(56) References Cited

U.S. PATENT DOCUMENTS

| | | | | |
|---|---|---|---|---|
| 2,575,191 | A * | 11/1951 | Seipp | B65D 31/04 383/97 |
| 4,018,911 | A * | 4/1977 | Lionetti | A61K 35/18 424/533 |
| 4,428,204 | A | 1/1984 | Brister | |
| 4,869,398 | A * | 9/1989 | Colvin | A61J 1/1462 222/83 |
| 5,211,900 | A * | 5/1993 | Ziegler | B29C 33/126 165/10 |
| 5,364,385 | A * | 11/1994 | Harms | A61J 1/05 604/403 |

(Continued)

FOREIGN PATENT DOCUMENTS

EP 0 520 822 A1 12/1992

OTHER PUBLICATIONS

Great Britain Search Report for GB 1807884.0, dated Oct. 24, 2018, 2 pages.

*Primary Examiner* — Emmanuel E Duke
(74) *Attorney, Agent, or Firm* — Joshua L. Cohen

(57) ABSTRACT

A method and apparatus for freezing the contents of a freezer storage bag are disclosed. A cooling duct is mounted with or without spacers inside of a freezer storage bag that contains a liquid that can be frozen. A liquid coolant is first fed to a heat exchanger thereby forming a gaseous coolant. The gaseous coolant is fed to a manifold and from the manifold to at least one cooling duct present in the freezer storage bag. The gaseous coolant is circulated through the cooling duct thereby imparting freezing to the liquid in the freezer storage bag.

6 Claims, 14 Drawing Sheets

(56) References Cited

U.S. PATENT DOCUMENTS

| | | | | |
|---|---|---|---|---|
| 2003/0080126 | A1* | 5/2003 | Voute | A01N 1/00 220/9.4 |
| 2006/0117788 | A1 | 6/2006 | Morano et al. | |
| 2009/0113753 | A1* | 5/2009 | Pepper | A61J 1/10 34/284 |
| 2009/0140005 | A1* | 6/2009 | Reichert | A45F 3/20 222/95 |
| 2015/0128619 | A1* | 5/2015 | Wild | F25D 31/007 62/64 |
| 2015/0354886 | A1* | 12/2015 | Sinko | F25D 31/006 62/390 |
| 2017/0280937 | A1* | 10/2017 | Mogil | A47J 41/0066 |

* cited by examiner

METHODS AND APPARATUS FOR FREEZING A LIQUID

BACKGROUND OF THE INVENTION

The freezing and thawing of large amounts of bulk liquids packed in flexible bags and/or rigid containers takes a long time due to limited cooling capacity of the freezing equipment, low overall heat transfer coefficient and the large size of the containers. This will affect the homogeneity of the products being frozen due to changes in product concentration throughout the container as it freezes.

Rapid or shock freezing is intended to alleviate these issues by reducing the freezing time and helping to maintain uniform concentrations, while quick thawing effectively converts the frozen product back to its liquid state so it can be readily used.

Current state-of-the-art fast freezing technologies utilize cabinet freezers and modified freeze dryers where packaged liquids are placed on or between cooled shelves, which are cooled using mechanical and sometimes cryogenic cooling systems. The rate of freezing is determined by the overall thermal resistance of the systems which in this case quite high due to slow heat transfer through the packaging wall as the heat needs to pass through multiple protective layers designed to prevent damages as a result of contact with cold media as well as ineffective heat transfer on the inside of the package primarily due to natural convection.

The present invention provides a method and apparatus for addressing these shortcomings and improving the freezing of liquids.

SUMMARY OF THE INVENTION

In one embodiment of the invention there is disclosed a method for freezing a liquid in a freezer storage bag comprising feeding a coolant to a cooling duct present in the freezer storage bag.

In a different embodiment of the invention, there is disclosed a method for freezing a liquid in a freezer storage bag comprising the steps of feeding a liquid coolant to a heat exchanger thereby forming a gaseous coolant; feeding the gaseous coolant to a manifold; feeding the gaseous coolant from the manifold to at least one cooling duct present in the freezer storage bag; circulating the gaseous coolant through the cooling duct thereby imparting freezing to the liquid in the freezer storage bag; and recovering the gaseous coolant from the cooling duct.

In another embodiment of the invention, there is disclosed a method of freezing a liquid in a freezer storage bag comprising the steps of sucking in a cold gaseous atmosphere inside a freezing cabinet by means of a blower; feeding the cold gas to a manifold; feeding the cold gas from the manifold to at least one cooling duct present in the freezer storage bag; circulating the cold gas through the at least one cooling duct thereby imparting freezing to the liquid in the freezer storage bag; and recovering the cold gas from the cooling duct.

In another embodiment of the invention, there is disclosed a storage unit comprising a freezer storage bag with a cooling duct embedded within the freezer storage bag.

The methods of the present invention are typically applicable to liquids that are water or water soluble substances. However, the liquid that is frozen can be fat-soluble.

For purposes of the present invention, the term freezer storage bag will include freezer storage bags or other containers that are typically used in freezing operations. The freezer storage bags for pharmaceutical use will typically be made of ethylene-vinyl acetate (EVA), thermoplastic elastomers (TPE), polyvinylchloride (PVC) and be cold resistant to −50° C. or below.

The freezer storage bags can range in storage size from 100 milliliters to 50 liters.

Typically, the freezer storage bag will be present in a freezer unit where it will lay flat upon a freezer shelf. Depending upon the size of the freezer unit, more than one freezer bag may be present therein on more than one shelf.

In an alternative embodiment of the invention, the freezer storage bags may be hung or held vertically within the freezer unit. When the freezer bags are in this position, the use of the cooling ducts becomes more pronounced because there are no shelves to assist in providing cooling to the freezer storage bags and their content. Therefore, when held vertically, the heat removal by the cooling ducts improves the efficiency of the freezing operation.

The retaining bracket is part of the freezer storage bag design as it is cut out from the bag material with a circumferential weld seam.

The freezer storage bags are filled with the liquid before they are loaded into the cabinet freezer.

The coolant is typically nitrogen but when air is used in the atmosphere in a freezer cabinet, it will be circulated through the cooling duct. Alternatively, if carbon dioxide is employed in the atmosphere, then it can be used as the coolant. In situations where a liquid coolant is employed in the freezing operation, then these can be employed. Typically, a liquid coolant would be brine or ethanol.

The cooling duct can both assist an external freezer in freezing the freezer storage bag and provide the necessary cooling to freeze the contents of the freezer storage bag on its own.

The cooling duct will typically be fabricated from the same material as the freezer bag. For pharmaceutical use, it must at least meet the legal requirements e.g. of United States Food and Drug Administration (FDA).

The cooling duct is typically sized per the size of the freezer storage bag it is to be inserted into. This size ranges from 5 to 20 millimeters in diameter.

The cooling duct will typically be welded into the freezer storage bag. Such freezer storage bags are already equipped with ducts for filling, emptying and sampling of contents and are likewise welded to the freezer storage bag.

The manifold will typically be designed such that the same amount of coolant gas enters each individual coolant duct. This flow can be controlled by the supply pressure of the coolant by way of the back pressure of a blower, or pressure control valve. In practice, typically 2 to 30 lines can be employed from the manifold.

The lines are typically made from the same material as the freezer storage bag. If there is no direct contact with the material that is sought to be frozen, particularly pharmaceutical, then other materials can be used such as flexible steel lines.

A spacer or strap can be mounted or fixed to the cooling ducts in a manner to avoid rotation of the cooling duct. The spacers are typically fashioned from stainless steel or plastic materials like EVA. The spacers should be made from material that approved for pharmaceutical use as well as being resistant to cold. The spacers are typically fashioned in a rectangular cross section.

An operator would typically employ 2 or 3 spacers per cooling duct so a typical freezer storage bag may have 2 to 6 spacers present therein.

The spacers will be attached to the cooling duct by clamping. This mechanism relies on the clamp, in a relaxed position, being smaller than the outer diameter of the duct such that when the clamp expands, the spacer is securely held in place in the cooling duct.

When two or more cooling ducts are employed in a freezer storage bag, they are spaced apart by using the spacers having different leg lengths.

DETAILED DESCRIPTION OF THE INVENTION

Figure 1A:
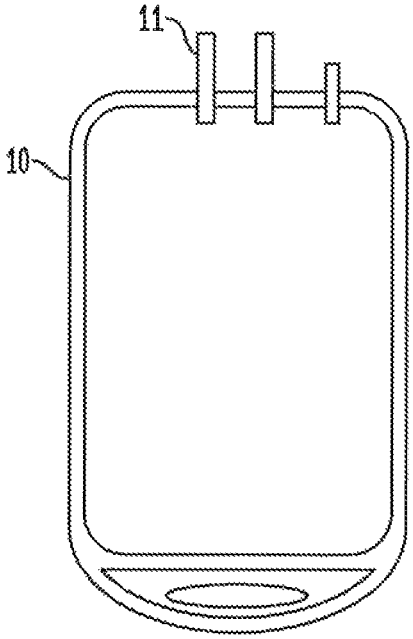
(PRIOR ART) FIG. 1A
FIG. 1A is an overhead view of a known freezer storage bag.

FIG. 1A is an overhead view of a bag 10 used for freezing. This prior art bag is equipped with a line 11 which is used for filling the bag 10 with the good that is to be frozen.

Figure 1B:
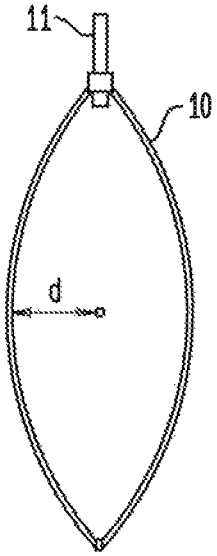
(PRIOR ART) FIG. 1B
FIG. 1B is a side view of the known freezer storage bag in FIG. 1A.

FIG. 1B is a sideways view of the prior art freezing bag 10 showing the filling line 11. Of interest is the measurement denoted d which is the maximum distance of the good to be frozen to the outside of the wall of the bag 10. The larger this maximum distance d, the longer it takes to completely freeze the good in the bag 10.

The longer the time it takes to freeze the contents of a freezer storage bag, the more expensive and inefficient the operation of freezing. The solution to this problem is to minimize the distance d thereby making the overall process of freezing the contents of a freezer bag quicker and more efficient.

Figure 2A:
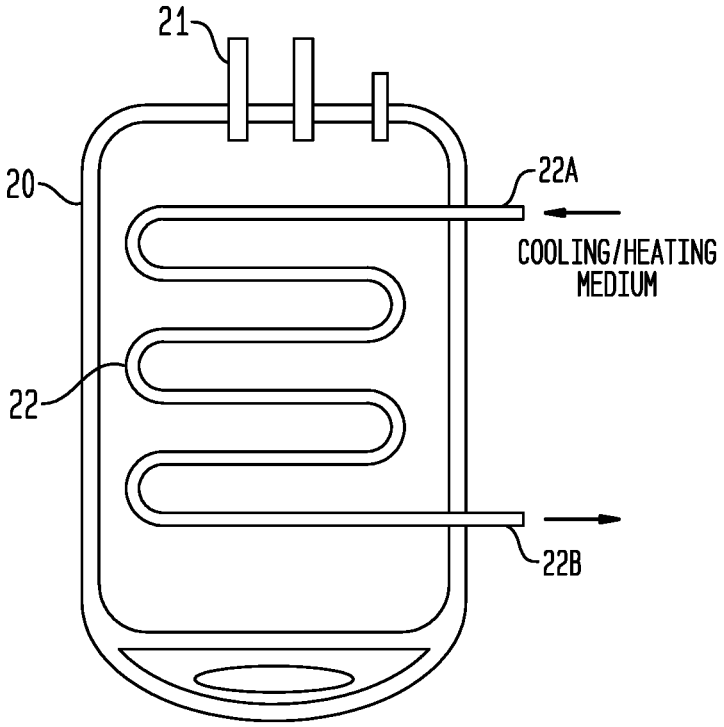
FIG. 2A is an overhead view of a freezer storage bag with a cooling duct present therein.

FIG. 2A describes one embodiment of the invention. This figures shows a freezer bag 20 from the top. Line 21 is used for filling the freezer bag 20 with an appropriate good to be frozen. A cooling duct 22 is shown entering the freezer bag 20 at input 22A and exiting the freezer bag through output 22B. A cooling or heating medium such as liquid nitrogen could be input into the freezer bag 20 and assist in reducing the time it takes to freeze the contents of the freezer bag 20.

The cooling duct 22 can be mounted or embedded in the freezer storage bag 20 in the same manner as the fill line 21 used for filling and removing goods from the freezer storage bag 20. One means for embedding the cooling duct as well as the fill lines in general is by plastic welding, particularly when the freezer storage bag is made of a soft plastic material.

Figure 2B:
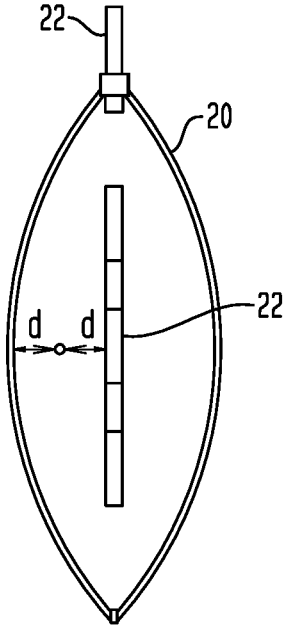
FIG. 2B is a sideways view of the freezer storage bag of FIG. 2A.

A side view of the freezer storage bag 20 is shown in FIG. 2B. This view shows the cooling duct 22 being flat and on a single plane within the freezer storage bag 20, as well as its relative position to the fill line 21. Of note is that compared with the prior art freezer storage bag of FIGS. 1A and 1B, the maximum distance d is now roughly half in FIGS. 2A and 2B. As such, the time to achieve complete freezing of the good in the freezer storage bag 20 will be faster.

It can be seen then that it is important to embed the appropriate cooling duct into the freezer storage bag in a manner that will reduce the distance from one wall of the freezer storage bag from its opposite wall thereby to reduce freezing time. Ideally, the cooling duct will be located within the middle of the freezer storage bag thereby ensuring that the distance to each wall of the bag is about the same. This will help to achieve a more uniform freezing process.

Figure 3A:
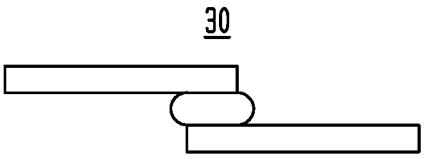
FIG. 3A is a top view of a spacer.
Figure 3B:
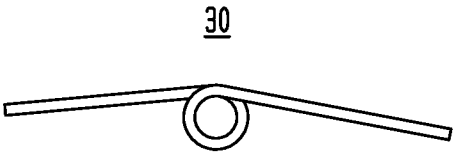
FIG. 3B is a side view of the space shown in FIG. 3A.
Figure 3C:
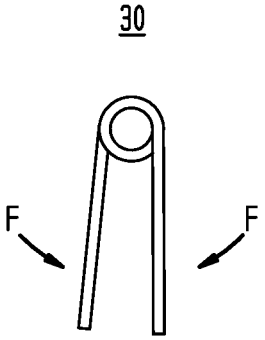
FIG. 3C is a side view of a compressed spacer of FIG. 3B.

As seen in FIGS. 3A, 3B and 3C, a spacer 30 is shown. The spacer 30 can be mounted or fixed to the cooling ducts in a manner to avoid rotation of the cooling duct. This affixation method can be for example welding or gluing of the spacer to the cooling duct. The spacer 30 must also exhibit retractable properties whereby the spacer is retracted by the application of force when, for example, the freezer storage bag is not in use and is stored in mostly a flat condition. The spacer can therefore be fabricated to behave like a spring that when the freezer storage bag is full of frozen goods, the spacer is extended. When the freezer storage bag has been emptied and is set aside for storage or shipment in a flat manner, the application of a small amount of outside pressure to the freezer storage bag will cause the spring to retract, allowing the freezer storage bag to remain flat while still containing the cooling duct(s) and spacer(s).

FIG. 3A therefor shows a top view of the spacer 30. FIG. 3B shows a sideways view of the spacer 30. FIG. 3C shows a version of FIG. 3B where forces F are being applied and the spacer 30 is in compression. This would be the situation where a freezer storage bag is not in use and is stored flat. Some pressure applied downwards would compress the spacer(s) thereby allowing the operator to store the freezer storage bags flat.

Figure 4A:
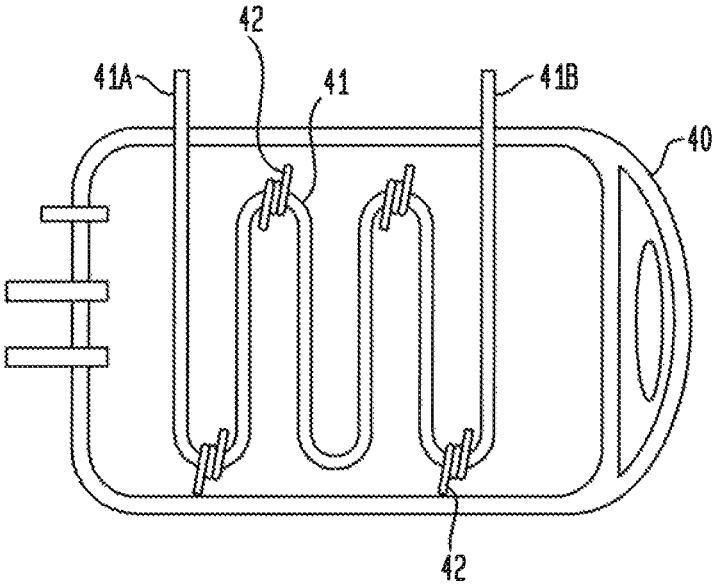
FIG. 4A is an overhead view of a freezer storage bag showing the positioning of a cooling duct and spacers.

FIG. 4A shows a freezer storage bag 40 from above demonstrating the use of more than one spacer 42 in connecting the cooling duct 41. A cooling fluid such as liquid nitrogen can be fed through input 41A where it will pass through the cooling duct 41 and be removed by outlet 41B. By positioning the spacers 42 at four discrete locations along the cooling duct 41, the cooling duct 41 is maintained in the middle of the freezer storage bag 40 and when in use for freezing a good, will optimize the freezing operation by maintaining an equidistance between the walls of the freezer storage bag 40.

Figure 4B:
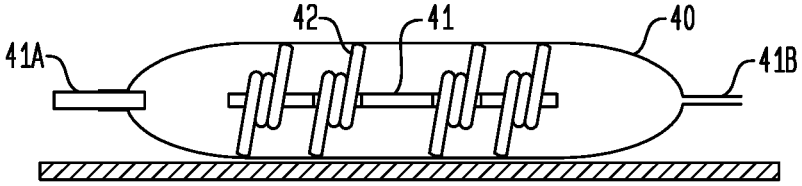
FIG. 4B is a side view of the freezer storage bag of FIG. 4A.

This positioning is also shown by FIG. 4B which is a sideways view of the freezer storage bag 40 of FIG. 4A. The freezer storage bag 40 is shown lying on a flat surface. The input 41A to the cooling duct 41 and output 41B are shown on opposite ends of the freezer storage bag 40 lengthwise. The spacers 42 are shown in contact with the cooling duct 41 in their expanded or open position. This positions the cooling duct 41 roughly equidistant between the two walls of the freezer storage bag 40 thereby improving on the efficiency of the cooling operation.

Figure 4C:
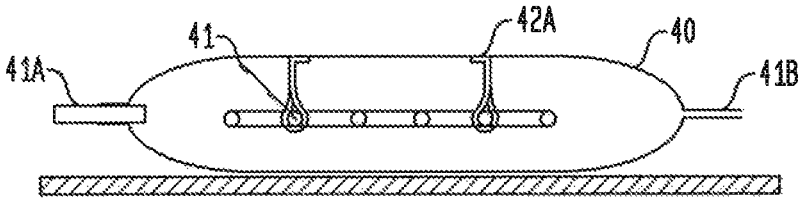
FIG. 4C is a side view of a freezer storage bag with a different design of spacer.

In an alternative embodiment of the freezer storage bag 40 shown in FIG. 4B, a different type of spacer is employed as shown in FIG. 4C. In this embodiment rather than a spring-like structure, the spacer 42A is fixed to the side of the freezer storage bag 40 and wound around in at least one loop around the cooling duct 41. Thus during a freezing operation, the freezer storage bag will suspend the cooling duct 41 from a wall of the freezer storage bag 40 by maintaining a connection between the wall of the freezer storage bag 40 and the cooling duct 41 through the strap 42A. This allows for the optimal distance to be achieved thereby improving on the efficiency of the freezing operation.

Figure 5:
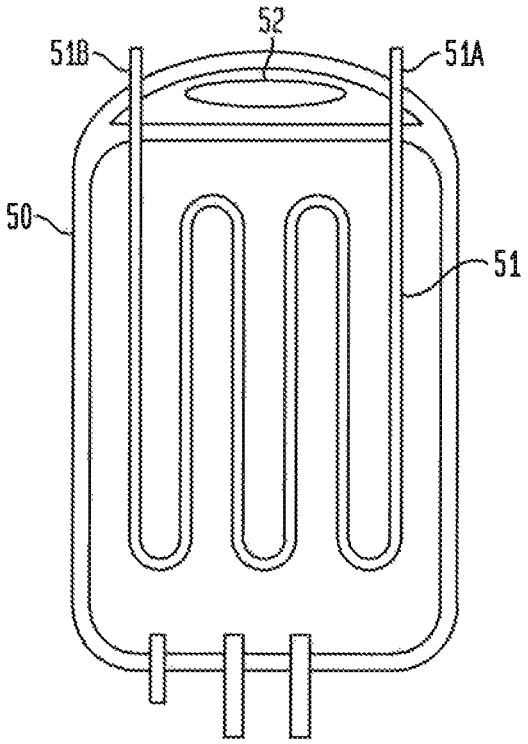
FIG. 5 is a side view of a freezer storage bag hung vertically.

FIG. 5 represents a different embodiment of the invention. The freezer storage bag 50 is held vertically by the retaining bracket 52. The cooling duct 51 thus hang vertically and is filled with a cooling fluid through input 51A and discharges the cooling fluid through output 51B. Gravity will thus keep the cooling duct 51 in the middle of the freezer storage bag 50 without using additional spacers or other connecting devices.

Figure 5A:
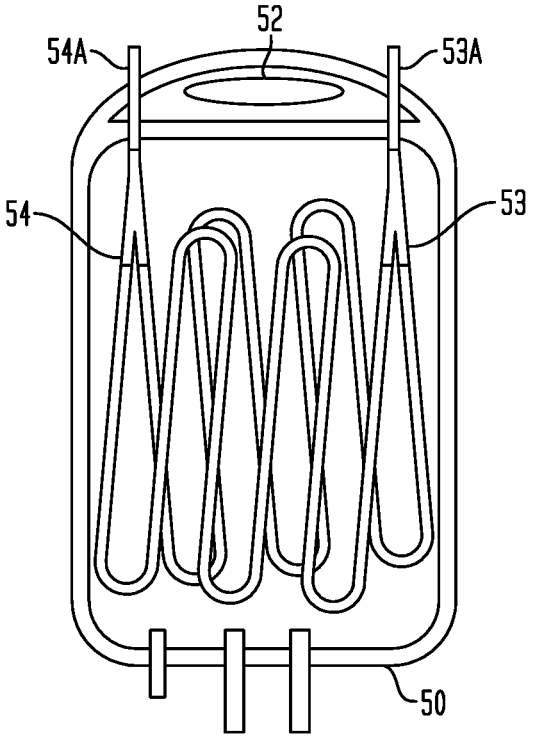
FIG. 5A is a side view of a freezer storage bag hung vertically with two cooling ducts.

FIG. 5A shows a different embodiment where the cooling duct is positioned via gravity in the freezer storage bag. In this embodiment, a second cooling duct is introduced in the freezer storage bag 50. This is a good arrangement in large freezer storage bags that can approach 50 liters in size. In this embodiment, a first inlet 53A feeds a first cooling duct 53 which hangs vertically by way of retaining bracket 52 in the freezer storage bag 50. Lined up in the same vertical arrangement but offset in terms of its distribution through the freezer storage bag 50 is cooling duct 54 which is fed coolant through inlet 54A.

Figure 5B:
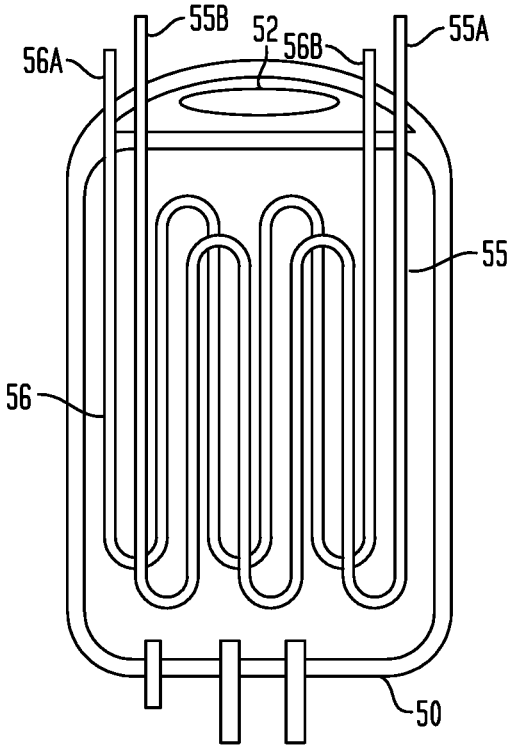
FIG. 5B is a side view of a freezer storage bag hung vertically with an internal and external cooling duct.

FIG. 5B shows a different embodiment where there are two coolant ducts arranged inside of the freezer storage bag. In this embodiment, the first cooling duct 56 is positioned to hang vertically by way of retaining bracket 52 in the freezer storage bag 50. An inlet 56A feeds coolant into the first cooling duct 56 and directs the output of coolant through output 56B.

A second cooling duct 55 is mounted as well in the freezer storage bag 50. Like the first internal cooling duct 56, it too hangs vertically. This second cooling duct is fed coolant through input 55A and discharges the coolant through output 55B. This embodiment is also good when a larger freezer storage bag is employed.

Figure 6:
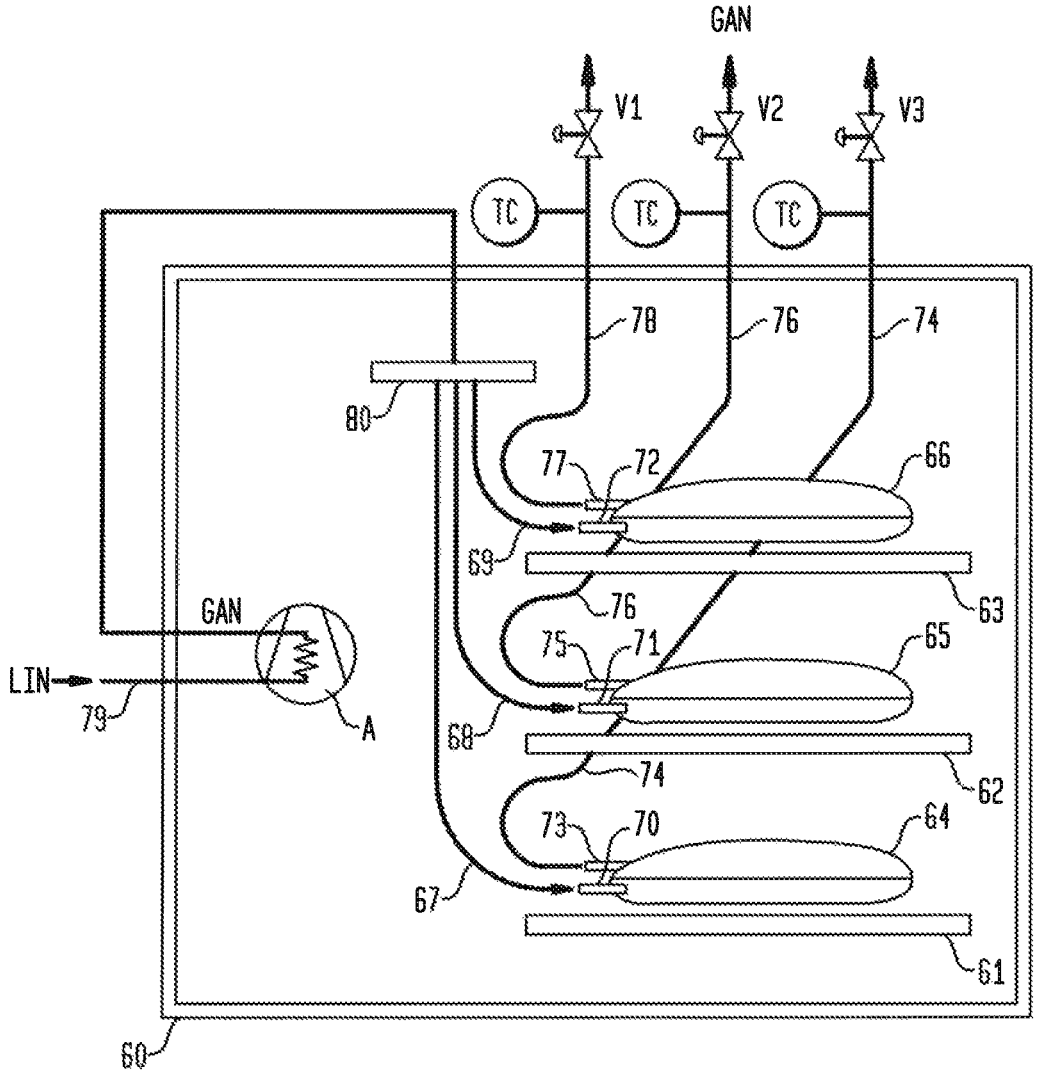
FIG. 6 is a side view of a freezer unit containing three freezer storage bags being fed coolant.

FIG. 6 is a schematic representation of at least one freezer storage bag being fed coolant. In this schematic a closed freezing unit 60 contains three shelves 61, 62, and 63 respectively. Liquid nitrogen is fed through line 79 and through heat exchanger A which cools the atmosphere inside the freezing unit 60. During the heat exchange operations, the liquid nitrogen becomes gaseous nitrogen GAN and is fed to a manifold 80 where the gaseous nitrogen is fed through lines 67, 68 and 69 respectively to the inputs 70, 71 and 72 respectively of three freezer storage bags 64, 65 and 66.

The gaseous nitrogen will flow through the inputs 70, 71 and 72 into the cooling ducts (not shown) of each of the three freezer storage bags 64, 65 and 66 and provide cooling to the contents therein. The cooling ducts may be held in place with spacers (not shown) to ensure that the cooling ducts are present in the middle of the bag, thereby providing optimum cooling and freezing to the contents of the freezer storage bags.

The flow of the gaseous nitrogen once it enters the freezer storage bags 64, 65 and 66 will be through individual valves, V3, V2 and V1 respectively. The nitrogen gas will flow through the output lines 73, 75 and 77 to output lines 74, 76 and 78 respectively and flow through the valves V3, V2 and V1 respectively where the nitrogen gas will be discharged in an environmentally conscious manner to the atmosphere.

Typical temperatures in freezing cabinets are −5° C. to −70° C. The flow rate depends upon the duct diameter. Typical velocities are 5 to 15 meters/second, The pressure in the ducts is approximately ambient, e.g., 1000+100 mbar (pressed) and 1000−100 mbar (sucked). At a duct diameter of 12 mm, the corresponding flow rate is in the range of 3 to 9 kilograms/hour.

Figure 7:
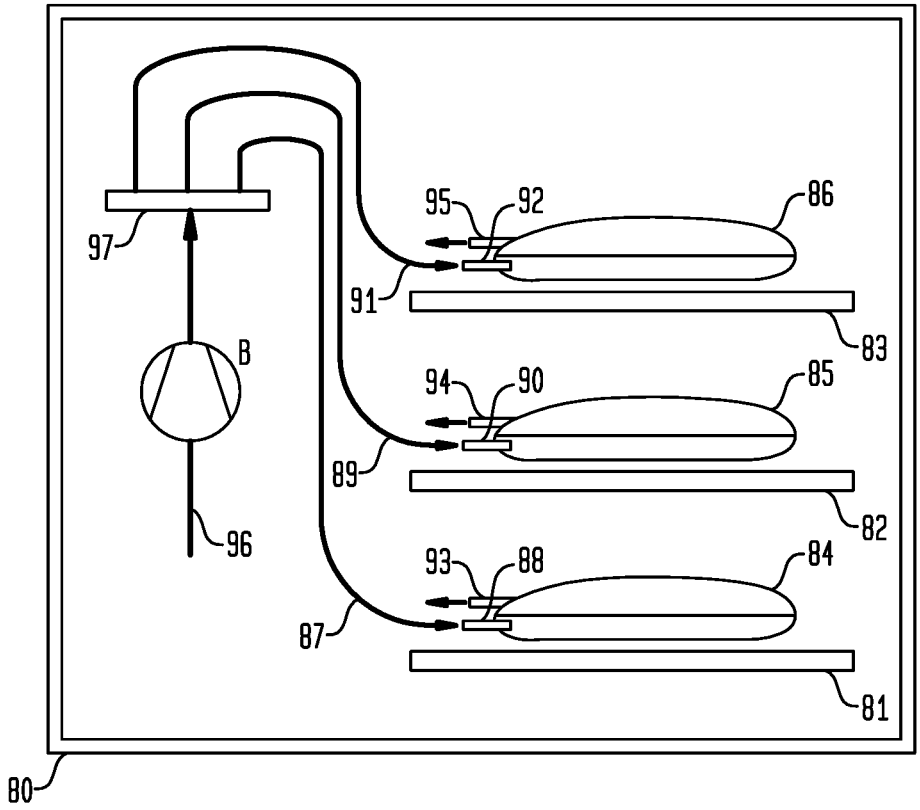
FIG. 7 is a side view of a freezer unit containing three freezer storage bags being fed coolant in an alternative manner.

FIG. 7 is a different embodiment of the invention shown in FIG. 6. A closed freezing cabinet 80 contains three freezer shelves 81, 82 and 83 which support on them three freezer storage bags 84, 85 and 86 respectively.

A blower B receives cold gas through line 96 and feeds it to a manifold 97. The manifold 97 connects through lines 87, 89, and 91 to the input connections 88, 90 and 92 of the three freezer storage bags 84, 85 and 86 respectively. The cold gas flows into the cooling ducts which are not shown and which may be supported by one or more spacers (also not show) such that the cooling duct is positioned approximately in the middle of each of the three freezer storage bags 84, 85 and 86. The cold gas is discharged from each of the freezer storage bags through lines 93, 94 and 95 respectively.

Alternatively, the cold gas can be sucked through the cooling ducts by means of blower B rather than pressed through the ducts. The advantage is that a blower warms up the gas. When sucking the gas through the ducts, it has a lower temperature and thus a better cooling potential.

Figure 8:
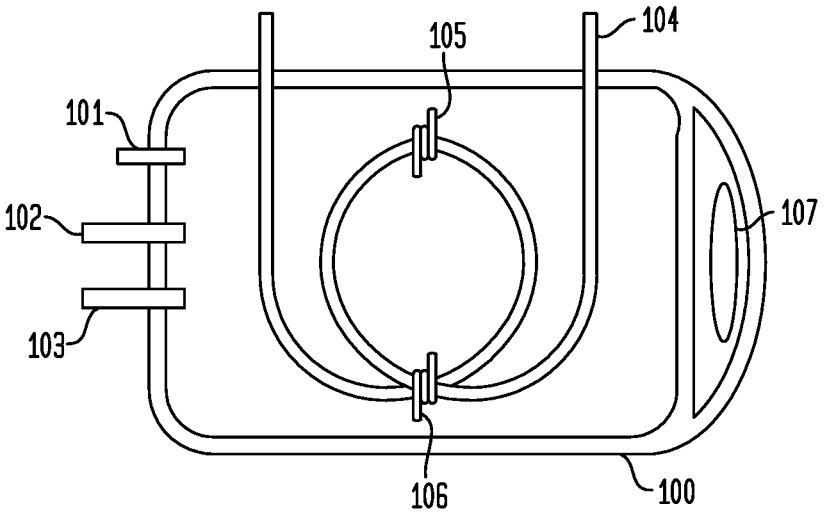
FIG. 8 is a side view of a freezer storage bag showing a different orientation of the cooling duct.

FIG. 8 shows a side view of a freezer storage bag where the ducts are oriented differently from those freezer bags earlier described. The freezer storage bag 100 is situated horizontally but can be held vertically by means of a retaining bracket 107. The liquid to be frozen is fed through line 101 into the freezer storage bag 100 to provide and can be removed through lines 102 and 103. A cooling duct 104 is mounted sideways compared to the embodiments of FIGS. 5, 5A and 5B and receives coolant through one end and expels it through the other end. The cooling duct 104 is held in place by two spacers 105 and 106 mounted opposite from each other. In this embodiment, the cooling duct 104 is positioned in a loop shape to thereby increase the amount of cooling duct surface area in the freezer storage bag 100.

While this invention has been described with respect to particular embodiments thereof, it is apparent that numerous other forms and modifications of the invention will be obvious to those skilled in the art. The appended claims in this invention generally should be construed to cover all such obvious forms and modifications which are within the true spirit and scope of the invention.

Having thus described the invention, what I claim is:

1. A method for freezing a liquid in a freezer storage hag comprising the steps of:

feeding a liquid coolant to a heat exchanger thereby forming a gaseous coolant;

feeding the gaseous coolant to a manifold;

feeding the gaseous coolant from the manifold to at least one cooling duct present in the freezer storage bag;

circulating the gaseous coolant through the at least one cooling duct thereby imparting freezing to the liquid in the freezer storage bag; and recovering the gaseous coolant from the at least one cooling duct;

wherein the at least one cooling duct is kept in a determined position when the storage bag is full by at least one spacer or strap.

2. The method as claimed in claim 1 wherein the liquid coolant is selected from the group consisting of brine and ethanol.

3. A method of freezing a liquid in a freezer storage bag comprising the steps of:

sucking in a cold gaseous atmosphere inside a freezing cabinet by means of a blower;

feeding a cold gas of the cold gaseous atmosphere to a manifold;

feeding the cold gas from the manifold to at least one cooling duct present in the freezer storage bag;

circulating the cold gas through the at least one cooling duct thereby imparting freezing to the liquid in the freezer storage bag; and recovering the cold gas from the at least one cooling duct;

wherein the at least one cooling duct is kept in a determined position when the freezer storage bag is full by at least one spacer or strap.

4. The method of freezing a liquid in a freezer storage bag as claimed in claim 3 wherein the cold gas is sucked out of the freezing cabinet through the at least one cooling duct and the manifold by means of the blower.

5. The method as claimed in claim 3 wherein the freezer storage bag filled with the liquid lays horizontally on a shelf or is held vertically in the freezing cabinet.

6. The method as claimed in claim 3 wherein the cold gas is selected from the group consisting of nitrogen, air and carbon dioxide.

* * * * *